US006003740A

United States Patent [19]

Castaneda, Jr.

[11] Patent Number: 6,003,740

[45] Date of Patent: Dec. 21, 1999

[54] HINGED LEVER ACTUATED SPRAY CAN

[76] Inventor: Sergio Castaneda, Jr., 2554 E. Oakwood, Gary, Ind. 46406

[21] Appl. No.: 09/119,012

[22] Filed: Jul. 20, 1998

[51] Int. Cl.[6] ..... B65D 83/14

[52] U.S. Cl. ..... 222/402.15; 222/518

[58] Field of Search ..... 222/402.1, 402.15, 222/509, 518, 321.8; 251/349; 239/579

[56] References Cited

U.S. PATENT DOCUMENTS 4,660,745 4/1987 Hess, Jr. ..... 222/402.15

4,826,054 5/1989 Frutin ..... 222/509

5,249,713 10/1993 Reich et al. ..... 222/402.15

5,529,215 6/1996 Banks et al. ..... 222/402.15

*Primary Examiner*—Philippe Detrakshani

*Attorney, Agent, or Firm*—Wallenstein & Wagner, Ltd.

[57] ABSTRACT

A side actuated spray can using a push bar hinged to a lever to depress the spray pipe emitting a flow of compressed contents.

6 Claims, 1 Drawing Sheet

HINGED LEVER ACTUATED SPRAY CAN

CROSS-REFERENCE TO RELATED APPLICATIONS

Not Applicable

STATEMENT REGARDING RECENT FEDERALLY SPONSORED RESEARCH OR DEVELOPMENT

Not Applicable

REFERENCE TO MICROFICHE APPENDIX

Not Applicable.

BACKGROUND OF THE INVENTION

1. Field of Invention

The present invention relates to a squirting or spraying device whose emission is parallel to the length of the compressed sealed container of emission source, and whose actuator button is able to be located well behind the emission point by use of a lever system.

2. Description of the Prior Art

No similar spraying device using a lever system to locate the actuator button well behind the emission point has been found.

BRIEF SUMMARY OF THE INVENTION

It is the object of the invention to provide a squirting or spraying device whose actuator button is located well behind the point of spray emission. There are occasions when the point of emission is safer and more advantageously situated away from the operator's hand and in the direction of the operating thumb such as when spraying insects or employing anti-personnel pepper spray. The can itself can therefore lend itself to greater uses such as a stick or the handle to another device. The emission pipe is pressed down by a lever whose fulcrum is based on and radiates directly out from the front end of the can near the emission pipe, the other end of said lever being hinged to a push bar running towards the back or other end of the compressed spray can. By forward thumb action against a button at the back end of the push bar, force is directed to depress the emission pipe releasing a spray from its' opening.

DETAILED DESCRIPTION OF DRAWINGS

Figure 1:
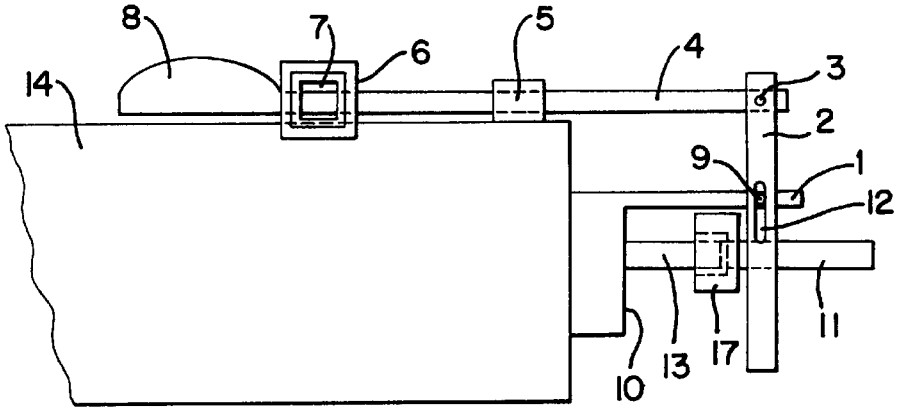
FIG. 1 is a side view of the hinged lever actuated spray can.
Figure 2:
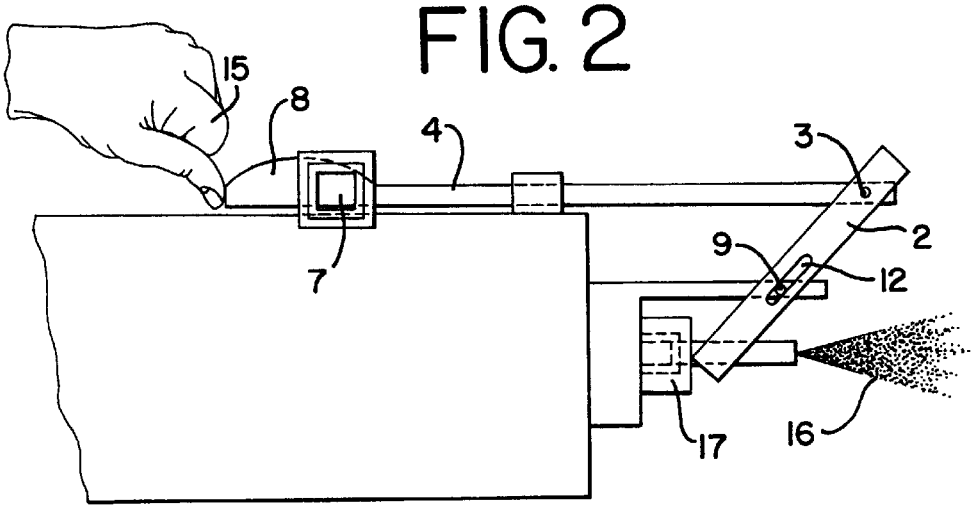
FIG. 2 is a side view of the hinged lever actuated spray can.
Figure 3:
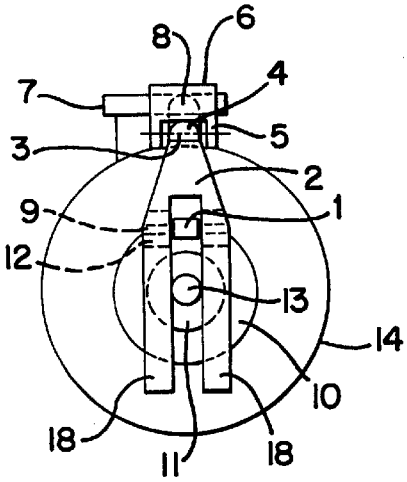
FIG. 3 is a front-end view of the hinged lever actuated spray can.

FIG. 1 displays a side view of the hinged lever actuated spray can unactuated. When push bar button 8 FIG. 2 is pressed forward by the operator's thumb 15 FIG. 2 until stopped by combination push bar guide and safety bolt guide 6, safety bolt 7 already being pulled back, push bar 4 is positioned forward being also guided by guide 5 pushing lever 2 out via hinge 3, said lever 2 rotating clockwise about fulcrum 9, and adjustably sliding down slot 12 pushing, by leveraged force, against spray pipe collared cap 11 depressing spray pipe 13 releasing emission spray 16.

Fulcrum 9 is the transverse member of fulcrum cross 1 securely based and arising directly from an uppermost section of the spray can 10 near the spray pipe 13. The left and right sections of fulcrum 9 extend tangently to the circumference about the centerline from top to bottom of said can and are secured slidabley up and down into slot 12 of lever 2. Lever 2 is a two pronged fork whose prongs 18 begin slightly above fulcrum 9 and whose space between prongs 18 allows lever 2 to adjustably rotate about fulcrum 9 and the sliding depressing action against the left and right sides of collar 17 of the spray pip collared cap 11.

I claim:

1. A spray can filled with a fluid contents, the spray can comprising:

a side wall joining opposing top and bottom ends, the top end having a spray pipe with an outlet for releasing the fluid contents of the spray can; and a lever for triggering the spray pipe, the lever rotatably hinged to a fulcrum positioned proximate the spray pipe, the lever having a proximal end in operative communication with the spray pipe and a distal end rotatably hinged to a push bar, the push bar being slideably attached to the side wall of the spray can wherein advancing the push bar upwardly towards the top end of the spray can causes the lever to rotate about the fulcrum so that a force from the proximal end of the lever on the spray pipe causes the fluid contents to be released from the spray can.

2. The spray can of claim 1 further comprising a spray cap having a collar portion extending outwardly and in communication with the lever and attached to the spray pipe wherein the lever forces the collar downwardly which forces the spray pipe downwardly to expel the contents of the spray can.

3. The spray can of claim 2 wherein the spray cap includes an emission opening through which the fluid contents of the spray can passes as it is expelled from the spay can.

4. The spray can of claim 2 wherein the emission opening is vertically aligned with the outlet of the spray pipe.

5. The spray can of claim 2 wherein the lever includes a pair of spaced prongs, the spray cap being positioned between the prongs and each prong being in communication with the collar.

6. The spray can of claim 1 wherein the lever includes a slot located between the proximal and distal ends for hingedly connecting the fulcrum to the lever.

* * * * *